United States Patent [19]

Hixenbaugh

[11] Patent Number: 4,485,841

[45] Date of Patent: Dec. 4, 1984

[54] POLLUTION CONTROL DEVICE

[75] Inventor: Dennis L. Hixenbaugh, Pittsburgh, Pa.

[73] Assignee: Pennsylvania Engineering Corporation, Pittsburgh, Pa.

[21] Appl. No.: 498,797

[22] Filed: May 27, 1983

[51] Int. Cl.[3] ..... F16K 51/00

[52] U.S. Cl. ..... 137/315; 49/74

[58] Field of Search ..... 49/74, 92, 403; 98/110, 98/121 A; 137/315, 601; 251/298; 126/291

[56] References Cited

U.S. PATENT DOCUMENTS 3,281,113 10/1966 Ahern ..... 137/601 X 4,029,002 6/1977 Valdas ..... 98/121 A X

FOREIGN PATENT DOCUMENTS 367679 4/1963 Switzerland ..... 137/315

*Primary Examiner*—Harold Joyce

*Attorney, Agent, or Firm*—Fred Wiviott

[57] ABSTRACT

A damper assembly for use with the inlet duct of a pollution control system includes a plurality of vanes which are pivotally mounted for movement between an open position and a closed position wherein the vanes coact to close the duct. Each vane is pivotally mounted at one end on a closure plate releasably affixed over an opening sized to permit the vane to be removed therethrough. The vanes also include a hanger member receivable on a trolley rod which may be inserted into a second opening in the duct for supporting the vane after it has been disconnected from its pivot support and as it is being slid through the opening and into and out of position within the duct.

10 Claims, 4 Drawing Figures

POLLUTION CONTROL DEVICE

BACKGROUND OF THE INVENTION

The invention relates to pollution control devices and more particularly to a damper for the inlet duct of a pollution control system.

In the control of discharge gases from metalurgical apparatus and the like, dampers are provided in the inlet duct which couples the apparatus or its enclosure to a gas cleaning system. Such dampers are subject to damage as the result of the high temperature of the effluent gases discharging from the metalurgical apparatus. In addition, the damper may be damaged by particles of hot metal or slag which may be entrained in the discharge gases or may be expelled from the metalurgical apparatus during a treatment process. As a result, the dampers must be periodically replaced or repaired. When such maintenance was required with respect to prior art dampers, it was necessary to remove the entire damper frame. Such maintenance procedures were relatively time consuming thereby idling expensive apparatus.

SUMMARY OF THE INVENTION

It is an object of the invention to provide a new and improved damper for gas cleaning systems.

Another object of the invention is to provide a damper for gas cleaning systems which permits individual damper vanes to be removed and replaced without dismantling the duct or removing the entire damper frame.

A further object of the invention is to provide a damper for gas cleaning systems which is particularly useful with metalurgical vessels.

These and other objects and advantages of the present invention will become more apparent from the detailed description thereof taken with the accompanying drawings.

In general terms the invention comprises a damper assembly for use with the inlet duct of a pollution control system and including first and second spaced apart support means. A plurality of spaced apart openings are formed in each support means and a plurality of elongate vein mains extending in a generally parallel relation between said support mains and each being in general alignment with one of the openings.

A plurality of first pivot means are each releasably mounted adjacent one opening for supporting the opposite ends of each vane means for pivotal movement of the vane means between a first position wherein said vanes inter-relate to substantially impede the flow of gas in said duct and a second open position.

One of the openings are aligned with each vane means and being of sufficient size to permit the vane means to be slid therethrough. Trolly means are provided for supporting the vane means for axial sliding movement through the openings whereby said vane means may be individually removed and replaced and cover means are releasably securable over each opening.

DETAILED DESCRIPTION OF THE PREFERRED EMBODIMENT

Figure 1:
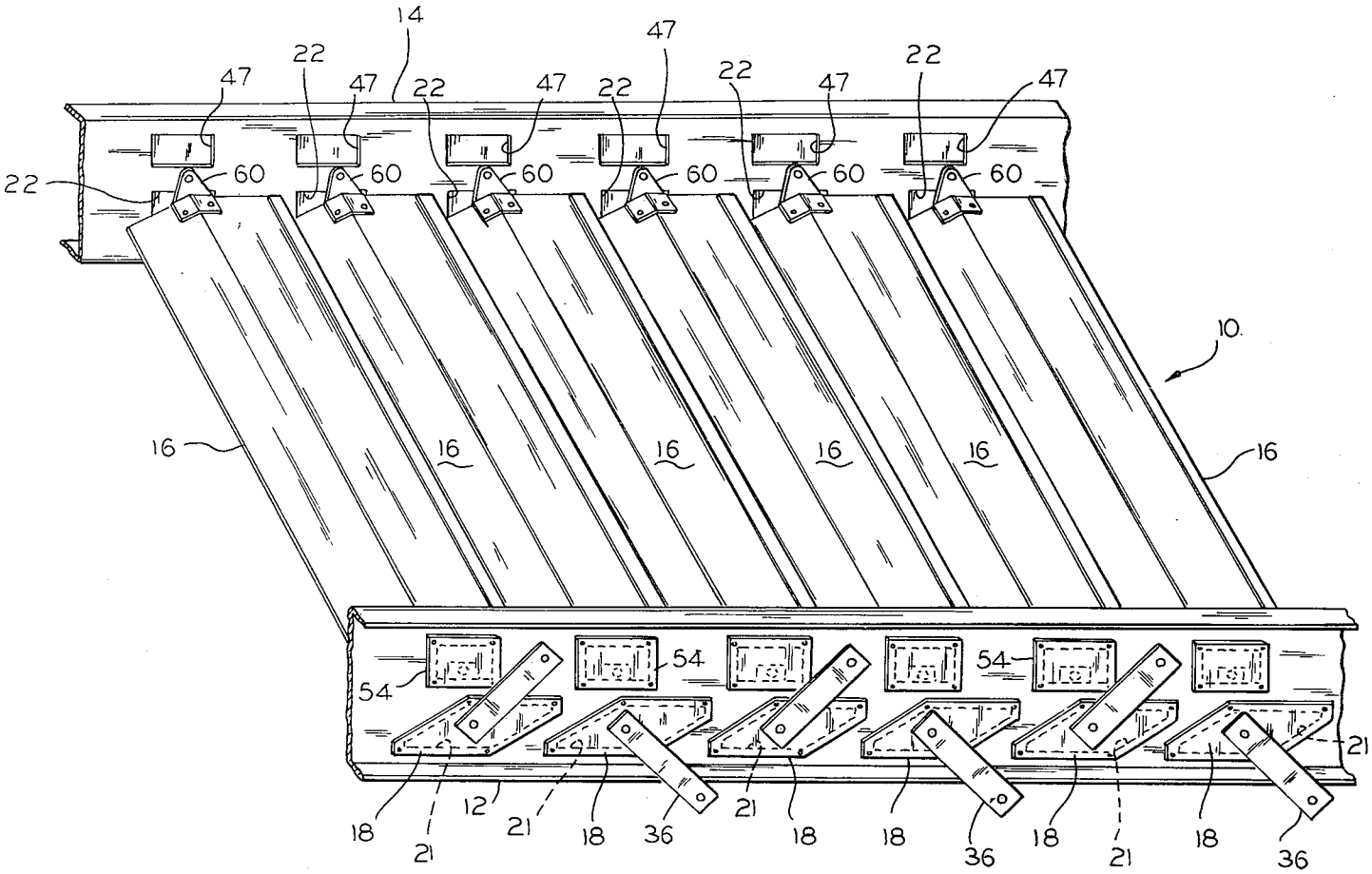
FIG. 1 is a perspective view of a portion of a damper in accordance with a preferred embodiment of the invention.

FIG. 1 shows a damper assembly 10 which is disposed in a duct (not shown). The duct may be of the type which couples a metalurgical vessel or an enclosure for such a vessel to a gas cleaning system. The damper 10 is provided for controlling the flow of gas into the cleaning system from a metal treating or processing enclosure.

Figure 2:
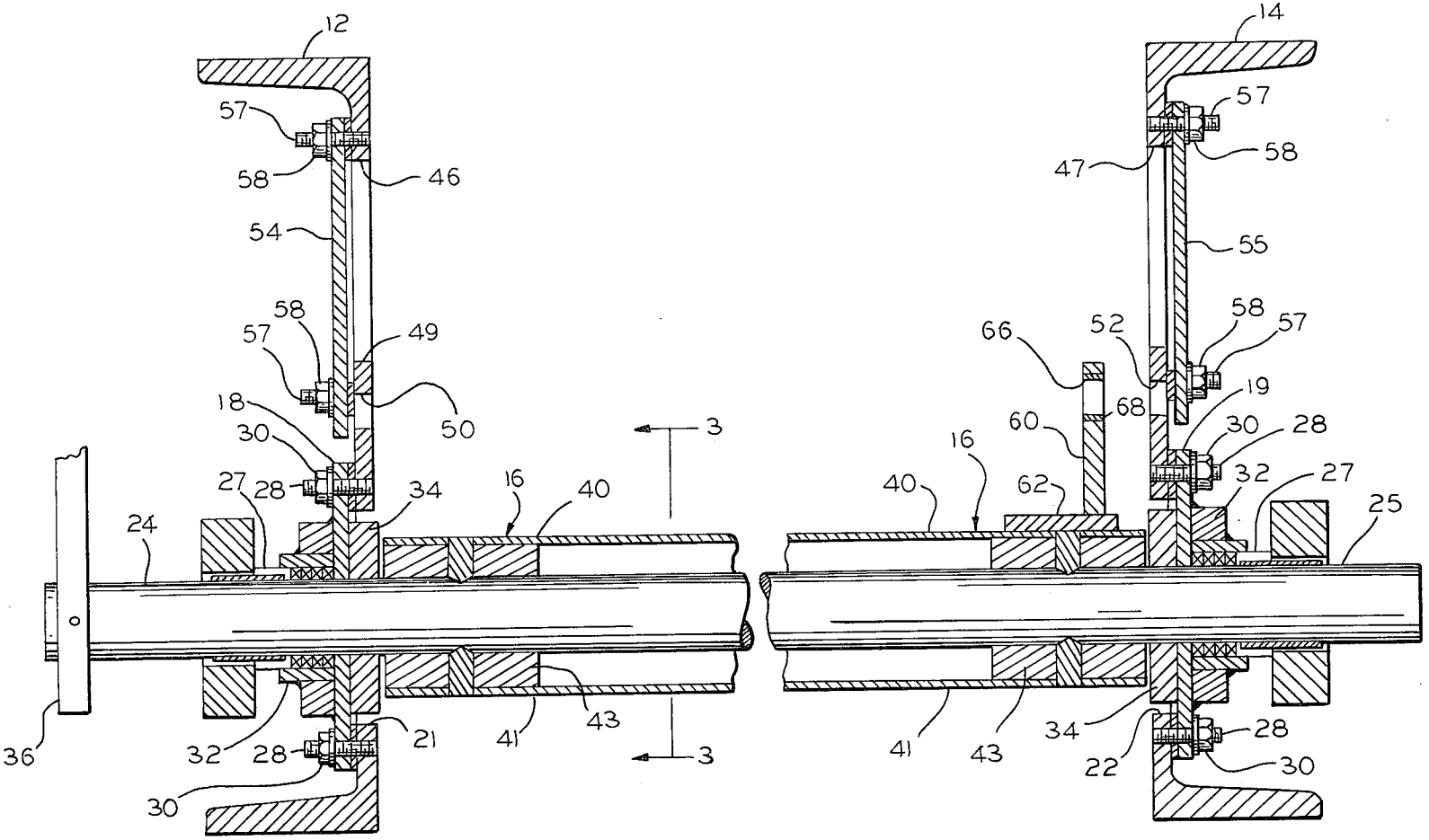
FIG. 2 is a side elevational view partly a section of a portion of the damper assembly illustrated in FIG. 1.

The damper includes a pair of spaced-apart frame members 12 and 14 which are fixed and form a part of the duct (not shown). Extending between the frames members 12 and 14 are a plurality of vanes 16. As seen more particularly in FIG. 2, each vane 16 is pivotally mounted at its opposite ends on cover plates 18 and 19 which are fixed over one of a plurality of spaced-apart openings 21 and 22 formed in frames 12 and 14 respectively. In particular, each vane 16 has stub shafts 24 and 25 extending from its opposite ends for being received in a suitable bearing 27 mounted in each of the end plates 18 and 19. The plates 18 and 19 are removably secured over their respective openings 21 and 22 by means of bolts 28 and nuts 30. In order to seal the passage of the stub shafts 24 and 25 through their respective plates 18 and 19, sealing gland 32 surrounds the shafts and abuts the outer surface of its respective plate. Also, to facilitate proper positioning of the vane 16 relative to the plates 18 and 19, a shim 34 is provided between each plate and the end of the vanes 16.

A pivot arm 36 is affixed to and extends radially from the shaft 24 of each vane 16. It will be appreciated that each arm 36 will be connected to an apparatus (not shown) but which is operative to simultaneously move the vanes 16 between a closed position shown by full lines in FIG. 3 to an open position shown by broken lines or to any desired intermediate position.

Figure 3:
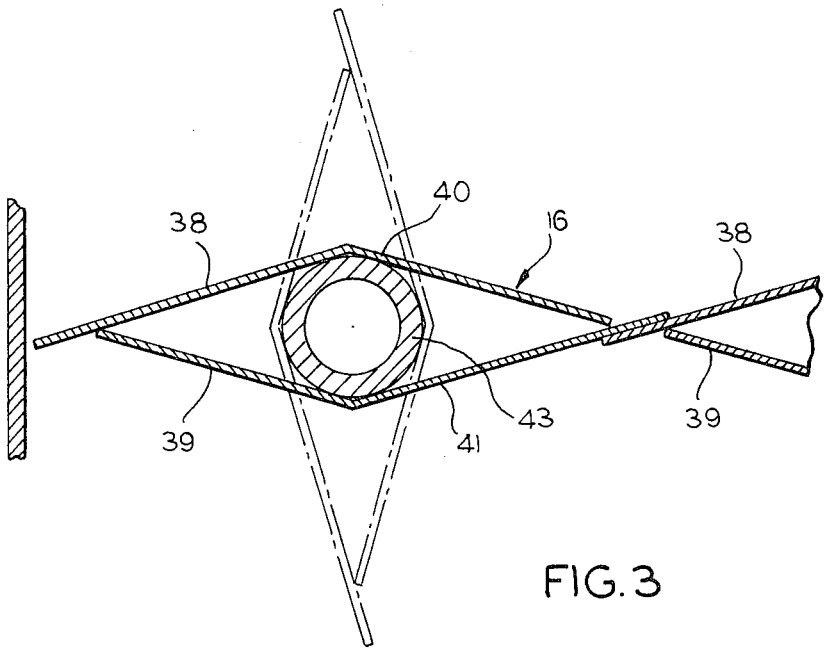
FIG. 3 is a view taken along lines 3—3 of FIG. 2.

Each vane is shown in FIG. 3 to include four blades, 38, 39, 40 and 41 which are affixed along their inner edges to each other and to sleeves 43 at each end to define a structure which is generally diamond shaped in transverse cross-section. In addition, the diagonally opposite plates 38 and 41 are wider than the plates 39 and 40 so that the edges of the former extend past the edges of the latter. This permits the edges of the lower blade 41 of one vane to engage in an overlapping relation to blade 38 of the adjacent vane so that the passage between the frame members 12 and 14 may be substantially blocked. The stub shafts 24 and 25 are also coaxially received within and are fixed to the sleeves 43 which forms the connection between each stub shaft and its respective vane 16.

Figure 4:
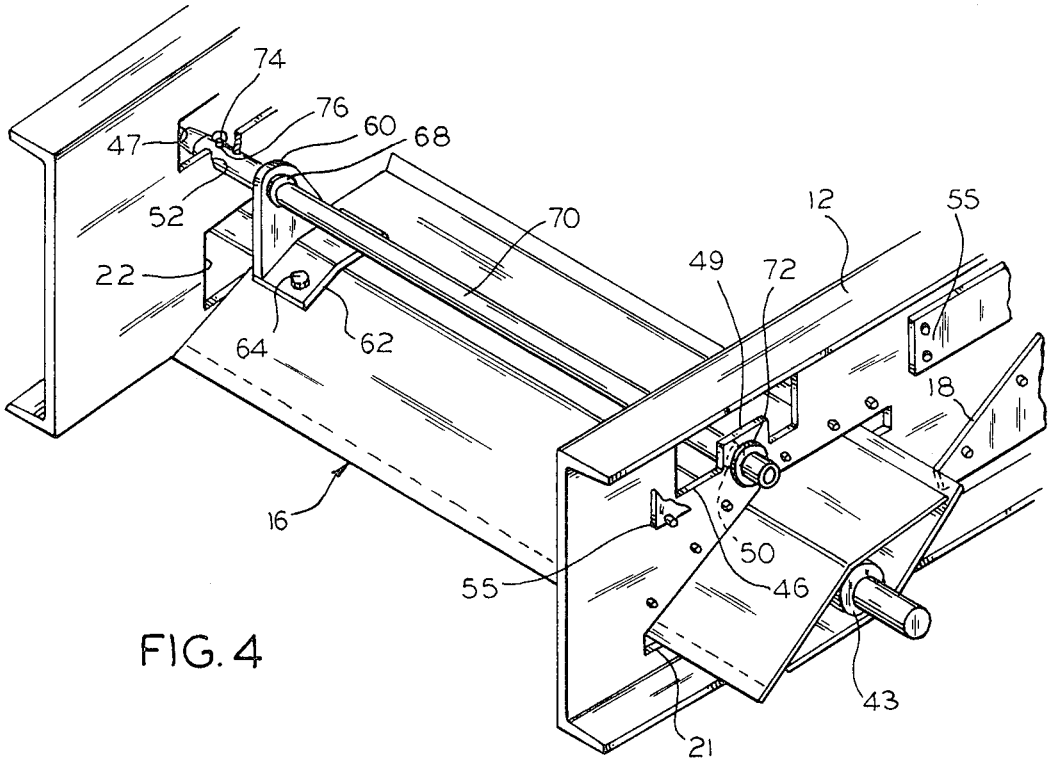
FIG. 4 is a perspective view of a portion of the damper illustrated in FIG. 1 and showing the method for removing an individual damper vane.

As seen in FIG. 4, each near side opening 21 is configured similarly to the transverse configuration of the vane 16 and is slightly larger to permit the vanes to slide therethrough. It will be appreciated that the total length of the openings 21 will exceed that of the frame member 12. For this reason, the right side of each opening as viewed in FIGS. 1 and 4 is tilted upwardly so that the openings and their associated cover plates 18 do not interfere one with the other. The far side opening 22 is shown to be generally rectangular and smaller than the near side opening 21.

Located above the openings 21 and 22 in each of the frames 12 and 14 are a second pair of access openings 46 and 47 which are generally rectangular except that the near side opening 46 has a central tab 49 extending upwardly from its lower side. A first circular opening 50 is formed in tab 49 and a second opening 52 is formed in the far side frame member 14 coaxially with opening 50 and below the far side opening 47. Plates 54 and 55 respectively cover the openings 46 and 47 and their associated openings 50 and 52. The plates 54 and 55 may be secured in any suitable manner such as by means of bolts 57 and nuts 58.

A tab 60 extends upwardly in the far end of each vane 16 and is affixed thereto by means of a lower flange 62 and bolts 64. An opening 66 is formed in each tab 60 coaxially with the openings 50 and 52 in frames 12 and 14 when the vane 16 is aligned with the opening 21. A flanged, split nylon bushing 68 is disposed within the opening 66.

FIG. 1 shows the vanes 16 in their normal operative relationship. When one of the vanes 16 is damaged or otherwise requires replacement, the cover plates 54 and 55 are first removed as shown in FIG. 4. This permits a trolley rod 70 to be inserted through the near side opening 50, the bushing 68 in the tab 60 and the far side opening 52 and until a collar 72 on rod 70 engages the front face of the frame 12. If necessary, the vane 16 may be pivoted to align the bushing 68 with the openings 50 and 52. After the trolley rod 70 has been fully inserted, a pin 74 is inserted through a transversed opening 76 in the far end of the trolley rod 70. This permits the far side of the vane 16 to be supported independently of the plate 19 and bearing 27 so that these components may then be removed along with the sealing gland 32. Next the arm 36 is disconnected from the operating mechanism and the plate 18 is disconnected from the frame 12 thereby permitting the vane 16 to be slid through the near side opening 21. After the vein has been moved sufficiently that the tab 60 is adjacent the near side opening 21 the bolts 64 are removed to disconnect the vane 16 from the tab 60 thereby permitting the vane to be fully withdrawn. A new vane may then be inserted through the opening 21, attached to the tab 60 and slid along the trolley rod until it is fully between the frames 12 and 14. The plates 18 and 19 there associated bearing 27 and packed glands 32 may then be reattached whereby vane 16 is again supported independently of a trolley rod 70. The pin 71 may then be removed from the far side of the trolley rod 70 permitting it to be withdrawn and the covers 54 and 55 reattached. The new vane is then ready for reconnection to the operating mechanism.

While only a single embodiment of the invention has been illustrated and described, it is not intended to be limited thereby, but only by the scope of the appended claims.

I claim:

1. A damper assembly for use with the inlet duct of a pollution control system, said damper assembly including first and second spaced apart support means, a first plurality of spaced apart access openings formed in at least one of said support means, a plurality of elongate vane means extending in a generally parallel relation between said support means and each being in general alignment with one of said openings, a plurality of first pivot means each removably mounted adjacent each opening and a releasably supporting one end of each vane means and second plurality of pivot means for releasably supporting the opposite end of each vane means on the other support means for pivotal movement of said vane means between a first position wherein said vane means inter-relate to substantially impede the flow of gas in said duct and a second open position, each of the said openings aligned with each vane means being of sufficient size to permit said vane means to be slid therethrough, and trolly means for supporting said vane means for axial sliding movement through said openings whereby said vane means may be individually removed and replaced, and cover means releasably securable over each of said openings.

2. The damper assembly set forth in claim 1 and including shaft means extending from each end of said vane means, said first and second pivot means comprising bearings, one of said first pivot means being mounted on each cover means and said bearings receiving said shaft means.

3. The damper assembly set forth in claim 2 wherein said trolly means includes elongate rod means, a plurality of rod receiving openings formed in each support means, each of said rod receiving openings in said first support means being generally co-axial with said rod receiving opening in said second support means, said elongate rod means being receivable in a pair of generally co-axial rod receiving openings and in a generally parallel relation to at least one of said vane means, and coupling means for slidably supporting said at least one vane means on said rod means whereby said vane means is supported after said bearing means are released from said shaft means and said vane means is being slid through said one opening.

4. The damper assembly set forth in claim 3 wherein there are a second plurality of openings formed in said second support means, each opening of said second plurality being in alignment with one of the openings of said first plurality of openings, one of said bearings being releasably mounted in each of said second plurality of openings, and cover means removably securable over each of said second plurality of openings.

5. The damper set forth in claim 3 wherein each of said vane means comprises an elongate vane having a cross-sectional configuration such that the edge of each vane overlaps that of the adjacent vanes when said vanes are in their first positions, the access openings being shaped complementary to the cross-sectional configuration of said vanes, each access opening being tilted relative to the adjacent openings.

6. The damper assembly set forth in claim 1 wherein said trolly means includes elongated rod means, a plurality of rod receiving openings formed in each support means, each of said rod receiving openings in said first support means being generally co-axial with said rod receiving opening in said second support means, said elongate rod means being receivable in a pair of generally co-axial rod receiving openings and in a generally parallel relation to at least one of said vane means, and coupling means for slidably supporting said at least one vane means on said rod means whereby said vane means is supported after said bearing means are released from said shaft means and said vane means is being slid through said one access opening.

7. The damper assembly set forth in claim 1 wherein there are a second plurality of openings formed in said second support means, each opening of said second plurality being in alignment with one of the openings of said first plurality of openings, one of said bearings being releasably mounted in each of said second plurality of openings, and cover means removably securable over each of said second plurality of openings.

8. The damper set forth in claim 1 wherein each of said vane means comprises an elongate vane having a cross-sectional configuration such that the edge of each vane overlaps that of the adjacent vanes when said vane means are in their first positions, the access openings being shaped complementary to the cross-sectional configuration of said vane means, each access opening being tilted relative to the adjacent openings.

9. The damper assembly set forth in claim 8 wherein there are a second plurality of openings formed in said second support means, each opening of said second plurality being in alignment with one of the openings of said first plurality of openings, one of said bearings being releasably mounted in each of said second plurality of openings, and cover means removably securable over each of said second openings.

10. The damper assembly set forth in claim 1 wherein said trolley means includes elongated rod means, a second plurality of openings formed in each support means vertically above said access openings, one of said second plurality openings in each support means being generally co-axial with an opening in the other support means, one of said elongate rod means being receivable in each pair of generally co-axial openings and a generally parallel relation to at least one of said vane means, removable tab means extending upwardly from each vane means and having an opening formed therein which is generally coaxial with the coaxial openings in the support means when the vane means is aligned with its access opening whereby said vane means can be supported on said rod means when said pivot means are released and said vane means is being slid through said access opening.

* * * * *